US007195081B2

(12) United States Patent
Mocivnik et al.

(10) Patent No.: US 7,195,081 B2
(45) Date of Patent: Mar. 27, 2007

(54) METHOD AND DEVICE FOR BORING HOLES IN SOIL OR ROCK

(75) Inventors: Josef Mocivnik, Fohnsdorf (AT); Renè Egger-Mocivnik, Judenburg (AT)

(73) Assignee: ALWAG Tunnelausbau Gesellschaft m.b.H., Pasching (AT)

( * ) Notice: Subject to any disclaimer, the term of this patent is extended or adjusted under 35 U.S.C. 154(b) by 0 days.

(21) Appl. No.: 11/395,291

(22) Filed: Apr. 3, 2006

(65) Prior Publication Data

US 2006/0175093 A1 Aug. 10, 2006

Related U.S. Application Data

(63) Continuation of application No. PCT/AT2004/000325, filed on Sep. 28, 2004.

(30) Foreign Application Priority Data

Oct. 1, 2003 (AT) ..... A 1559/2003

(51) Int. Cl.
*E21B 7/20* (2006.01)

(52) U.S. Cl. ..... 175/57; 175/171; 175/320

(58) Field of Classification Search ..... 175/320, 175/171, 57
See application file for complete search history.

(56) References Cited

U.S. PATENT DOCUMENTS 1,079,836 A * 11/1913 Canfield ..... 279/89
3,174,563 A 3/1965 Edblom et al. ..... 175/258
4,387,775 A * 6/1983 Adolfsson et al. ..... 175/135
5,472,057 A * 12/1995 Winfree ..... 175/57
5,845,722 A * 12/1998 Makohl et al. ..... 175/101
6,106,200 A 8/2000 Mocivnik et al. ..... 405/259
2004/0104050 A1* 6/2004 Jrvel et al. ..... 175/57

FOREIGN PATENT DOCUMENTS

EP 0358786 3/1990

* cited by examiner

*Primary Examiner*—Hoang Dang
(74) *Attorney, Agent, or Firm*—Jacobson Holman PLLC

(57) ABSTRACT

In a method and device for boring or drilling, in particular percussion drilling or rotary percussion drilling, holes in soil or rock, wherein a borehole is formed by a percussive and/or rotary movement carried out by a drill bit (2) mounted on a drill rod assembly (3) and a jacket tube (6) coupled with the drill bit (2) is introduced into the borehole, it is provided that the jacket tube (6) is received in a socket (5) provided on the end facing away from the drill bit working surface, of an envelope tube (4) coupled with the drill bit (2), and that the jacket tube (6) is subjected to a percussive and/or compressive stress on its end facing away from the drill bit, whereby directionally precise boring or drilling is rendered feasible.

16 Claims, 6 Drawing Sheets

FIG. 5
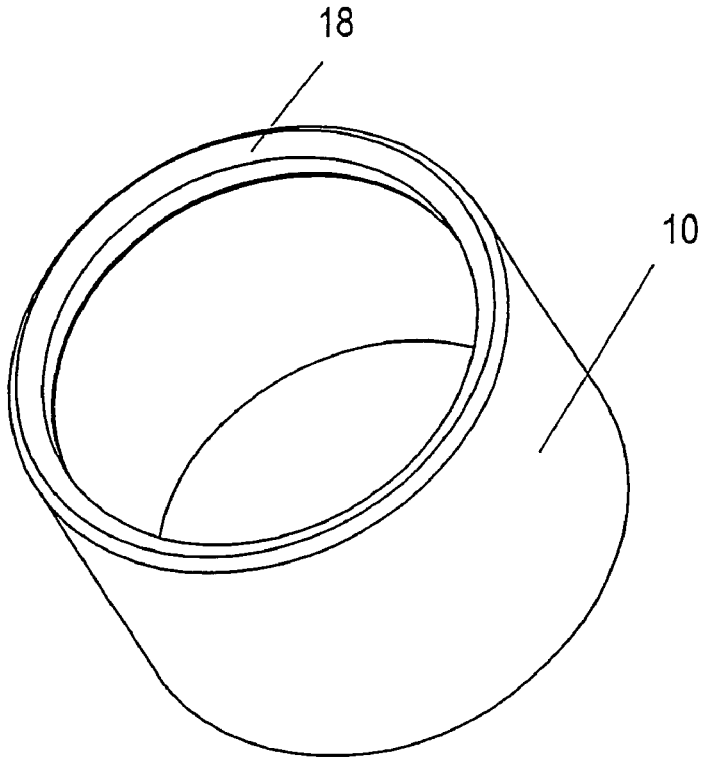
FIG. 5a
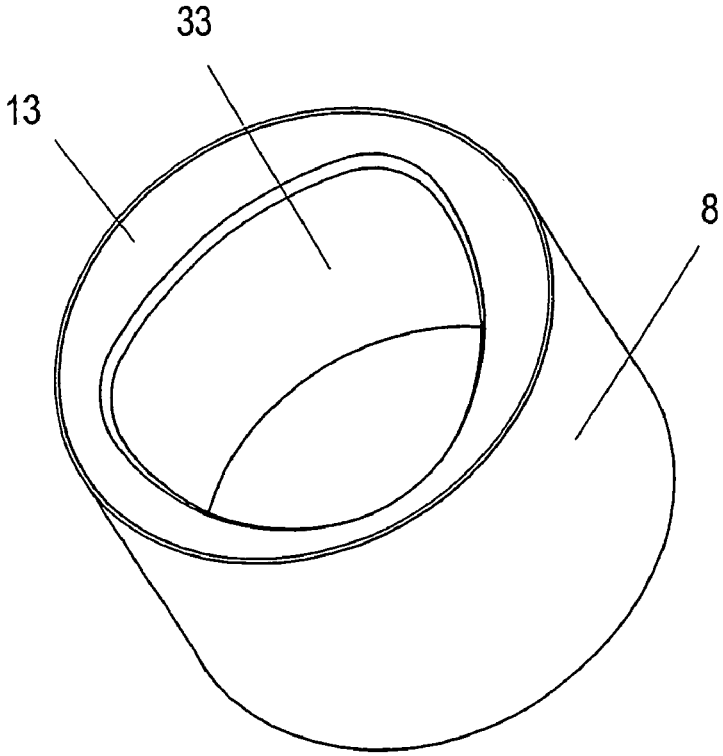
FIG. 5b

METHOD AND DEVICE FOR BORING HOLES IN SOIL OR ROCK

This is a continuation of PCT/AT2004/000325 filed 28 Sep. 2004 and published in German.

FIELD OF THE INVENTION

The present invention relates to a method for boring or drilling, in particular percussion drilling or rotary percussion drilling, holes in soil or rock, wherein a borehole is formed by a percussive and/or rotary movement carried out by a drill bit mounted on a drill rod assembly and a jacket tube coupled with the drill bit is introduced into the borehole, as well as a device for boring or drilling, in particular percussion drilling or rotary percussion drilling, holes in soil or rock, wherein a borehole is formed by a percussive and/or rotary movement carried out by a drill bit mounted on a drill rod assembly and a jacket tube coupled with the drill bit is capable of being introduced into the borehole.

PRIOR ART

In the context of producing holes in soil or rock by, in particular, percussion drilling or rotary percussion drilling, various embodiments are known, wherein, in general, a borehole is formed by a percussive and/or rotary movement by a drill bit mounted on a drill rod assembly and a jacket tube coupled with the drill bit is introduced into the borehole. Concerning the introduction of a jacket tube into the borehole, which is, for instance, intended to subsequently serve as a lining tube, it is known, on the one hand, to introduce the jacket tube into the interior of the borehole through tensile stress by appropriate coupling with the drill bit or an impact shoe connected therewith. Such a tensile entrainment of a borehole presupposes an accordingly thin and light-weight configuration of the jacket tube in order to avoid an excessive stress or strain resulting during the introduction of the jacket tube into the interior of the borehole. Alternately, it is known to introduce a jacket tube or an envelope tube into the interior of the borehole separately from the drill bit by exerting an impact stress on the end projecting out of the borehole. In addition, embodiments are known, in which all of the drilling work or drill feed is transmitted to the drill bit by an impact stress exerted on an accordingly sturdily designed envelope tube.

While a merely tensilely stressed and accordingly thin-walled jacket tube, in particular, offers advantages through an accordingly reduced force introduction for the insertion of the jacket tube, such a thin-walled jacket tube frequently involves the drawback of rendering accurate drilling impossible on account of the low strength of the jacket tube. On the other hand, accordingly sturdily designed envelope tubes involve the disadvantage of exerting a high frictional load on the peripheral walls of the borehole to be produced, with a separate and accordingly sturdy drive mechanism being, as a rule, additionally required for the introduction of the envelope tube.

Departing from a method and device of the initially defined kind, the present invention aims to provide a method and device for drilling holes in soil or rock, which render feasible by simple embodiments not only accurate and targeted drilling even over large lengths, but also the utilization of the advantages of a thin-walled jacket tube.

SUMMARY OF THE INVENTION

To solve these objects, a method of the initially defined kind is essentially characterized in that the jacket tube is received in a socket provided on the end facing away from the drill bit working surface, of an envelope tube coupled with the drill bit, and that the jacket tube is subjected to a percussive and/or compressive stress on its end facing away from the drill bit. Due to the fact the, in accordance with the invention, the jacket tube is received in a socket of an envelope tube coupled with the drill bit, and the jacket tube is subjected to a separate percussive and/or compressive stress on its end facing away from the drill bit, the introduction during boring of an envelope tube coupled with the drill bit and having a comparatively short length has become possible so as to ensure targeted and accurate boring via said envelope tube. Besides, the jacket tube is separately introduced into the interior of the borehole by a percussive and/or compressive stress such that no accordingly high energy need be exerted by the drill bit, or an impact shoe arranged, for instance, in the region of the drill bit, on the whole jacket tube to be introduced into the borehole. In addition, it is to be, anticipated that, with an accordingly accurate and precise formation of the borehole, the following jacket tube, which is usually of lower strength, can be introduced into the borehole interior in an accordingly simple manner without excessive friction resistances, also by applying an accordingly reduced percussive and/or compressive stress.

In order to ensure that the envelope tube is introduced or taken along into the borehole at least to the extent by which the jacket tube is subjected to percussive and/or compressive stresses on the end facing away from the drill bit, it is proposed according to a preferred embodiment that the compressive stress acting on the jacket tube on its end facing away from the drill bit is chosen to be smaller than the tensile stress exerted by the drill bit on the envelope tube. By choosing the compressive strength acting on the jacket tube to be smaller than the tensile stress exerted on the envelope tube, it is safeguarded that the jacket tube, which, in an advantageous manner, is received in the socket of the envelope tube merely by a simple plug-in connection, will not be introduced into the borehole by a larger extent than is the case for to the drill bit and the envelope tube coupled therewith, so that no upsetting stresses will be exerted on the jacket tube.

In order to ensure the proper introduction of both the envelope tube and the jacket tube while simultaneously taking into account the rotary and percussive stresses acting on the drill bit, it is proposed according to another preferred embodiment that the drill bit, in a manner known per se, is rotationally mounted relative to the envelope tube and/or jacket tube.

In order to ensure the simple and proper haulage of the excavated material from the region of the drill bit, it is proposed according to a further preferred embodiment that excavated material, via at least one opening provided in the region of the connection site between the drill bit and the envelope tube, and/or a passage opening provided at a distance from the connection site between the drill bit and the jacket tube, is introduced into the annular space defined between the outer periphery of the drill rod assembly and the inner peripheries of the envelope tube and the adjoining jacket tube, and carried off the borehole.

To achieve the initially defined objects, a device of the initially defined kind is essentially characterized in that the jacket tube is received in a socket provided on the end facing away from the working surface of the drill bit, of an envelope tube coupled with the drill bit, and that a percussive and/or compressive stress is exerted on the end of the jacket tube facing away from the drill bit. A structurally simple configuration will, thus, do while safeguarding the reliable and targeted introduction of the drill bit through the envelope tube coupled with the drill bit, without having to take into account influences possibly acting on the jacket tube and, hence, adverse effects on the boring accuracy.

For a simple force transmission aimed to carry the envelope tube along with the drill bit, it is proposed according to a preferred embodiment that, for the coupling of the envelope tube with the drill bit, a sleeve-like intermediate element is provided for the transmission of a tensile stress exerted by the drill rod assembly on the envelope tube. Such a sleeve-like intermediate element can be produced in a simple manner and provides a proper and reliable force transmission between the drill rod assembly, which is directly coupled with the drill bit for carrying out the drilling work, and the envelope tube.

For a particularly simple and reliable transmission of separate percussive and compressive stresses on-the jacket tube, it is proposed according to a further preferred embodiment that a sleeve-like intermediate element is provided for the transmission of a compressive stress exerted by the drill rod assembly on the jacket tube.

In order to be able to introduce large forces optionally required also with large drilling lengths, both onto the jacket tube and onto the envelope tube, which is substantially adapted to the dimensions of the borehole and, hence, subjected to an elevated friction resistance, it is proposed according to a further preferred embodiment that a stop surface of the sleeve-like intermediate elements provided between the drill rod assembly and the envelope tube as well as between the drill rod assembly and the jacket tube end facing away from the drill bit is each comprised of a stop surface enclosing an acute angle with the longitudinal axis of the drill rod assembly and the envelope tube and the jacket tube, which stop surfaces cooperate with respective complementary stop surfaces of the drill rod assembly or an adapter coupled therewith. Such stop surfaces can be made available in an accordingly cost-effective and precise manner for the proper and reliable force transmission and introduction both into the envelope tube and into the jacket tube.

According to another preferred embodiment, it is proposed that the stop surface of the intermediate element provided between the drill rod assembly and the envelope tube is larger than the stop surface of the intermediate element provided between the drill rod assembly and the jacket tube end facing away from the drill bit, whereby it is ensured that the tensile stress transmitted to the envelope tube is larger than the percussive stress exerted on the jacket tube, as already pointed out above.

For a proper drill feed, it is proposed according to a further preferred embodiment that the drill bit, in a manner known per se, is rotationally mounted relative to the envelope tube and/or jacket tube so as to reliably prevent the linear introduction of both the envelope tube and the jacket tube into the interior of the borehole apart from the rotational movement or the drill bit, which is necessary for the drilling procedure.

As already indicated above several times, the envelope tube ensures targeted and accurate drilling, which is further supported in that the outer diameter of the envelope tube exceeds the outer diameter of the jacket tube. The outer diameter of the envelope tube can, thus, be precisely tuned to the dimensions of the borehole to be produced, with the envelope tube having an accordingly short length such that the frictional forces generated by the snug abutment of the envelope tube on the inner wall of the borehole can be safely overcome while the adjoining jacket tube having an accordingly reduced diameter can be readily introduced into the interior of the borehole without large friction resistances.

To assist in the production of an accurate bore, it is proposed according to a further preferred embodiment that the envelope tube has an elevated cross section and/or elevated strength relative to the jacket tube. Due to the fact that the envelope tube has an elevated cross section and/or elevated strength, it will be safeguarded that deviations from the desired drilling direction on account of the strength or rigidity of the envelope tube will be prevented.

In order to provide a particularly simple and reliable connection of adjoining jacket tube elements, it is proposed according to a further preferred embodiment that, for the connection of adjoining jacket tube elements, sleeve-like elements are provided, each overlapping adjoining end regions of the jacket tube elements and formed, or capable of being formed, with projections or elevations engaging in complementary depressions or recesses provided about the peripheries of the jacket tube elements. Such projections or elevations engaging in complementary depressions or recesses are not only simple and cost-effective to produce, but, unlike conventional screw connections, also enable the reliable connection or coupling of jacket tube sections as a simple connection for extension in the usually rough boring or drilling operation. Moreover, such depressions or recesses and projections or elevations, respectively, will not be as easily damaged as in the case of known screw connections used to extend jacket tube elements.

For a particularly simple connection of neighboring jacket tube elements, it is proposed according to a further preferred embodiment that the sleeve-like elements are designed to have reduced material cross sections in the region of the projections or elevations, and that the projections or elevations are capable of being formed to correspond with the depressions of the jacket tube elements after the arrangement of the sleeve-like elements on the outer peripheries of the jacket tube elements to be connected.

In addition to the sleeve-like elements suggested for the connection of neighboring jacket tube elements, it is proposed according to a further preferred embodiment that additional securing elements such as, for instance, pin-shaped studs or spigots are provided for the positioning and/or fixing of the sleeve-like elements so as to enable an accordingly safe maintenance of connection positions.

For a particularly reliable haulage of excavated material from the region of the drill bit, it is proposed according to a further preferred embodiment that, in the region of fixation of the envelope tube to the drill bit and/or an impact shoe or adapter connected therewith, at least one passage opening for the introduction of excavated material into the annular space formed between the outer periphery of the drill rod assembly and the inner peripheries of the envelope tube and the adjoining jacket tube is provided.

To assist in the haulage of excavated material, or introduce material into the interior of the annular space between the envelope tube, or the adjoining jacket tube, and the outer periphery of the drill rod assembly, it is proposed according to a further preferred embodiment that the drill bit, or an adapter connected therewith, on its rear side facing away from the working surface, is provided with a polygonal profile which, at a retraction relative to the envelope tube, enters a complementary polygonal reception opening of the adapter or intermediate element for coupling with the envelope tube.

In addition to the option of introducing excavated material directly in the region of the connection site of the envelope tube and the drill bit, it is proposed according to a further preferred embodiment that at least one passage opening is provided on the periphery of the envelope tube at a distance from the connection site between the drill bit and/or adapter and the envelope tube, which passage opening opens into the interior of the annular space defined between the outer periphery of the drill rod assembly and the inner periphery of the envelope tube.

SHORT DESCRIPTION OF THE DRAWINGS

In the following, the invention will be explained in more detail by way of exemplary embodiments schematically illustrated in the accompanying drawing. Therein:

FIG. 5 depicts perspective views of intermediate elements, wherein FIG. 5*a* illustrates the intermediate element which serves to transmit a compressive stress from the drill rod assembly to the jacket tube, while FIG. 5*b* shows an intermediate element for the transmission of a tensile stress from the drill rod assembly to the envelope tube;

Figure 2:
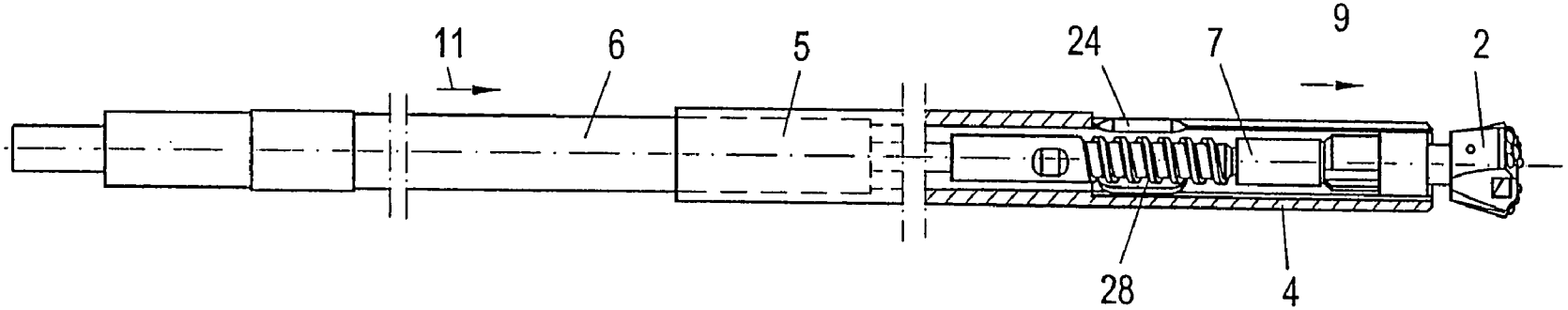
FIG. 2 is a partially sectioned side view of the device according to the invention in an illustration similar to that of FIG. 1.
Figure 8:
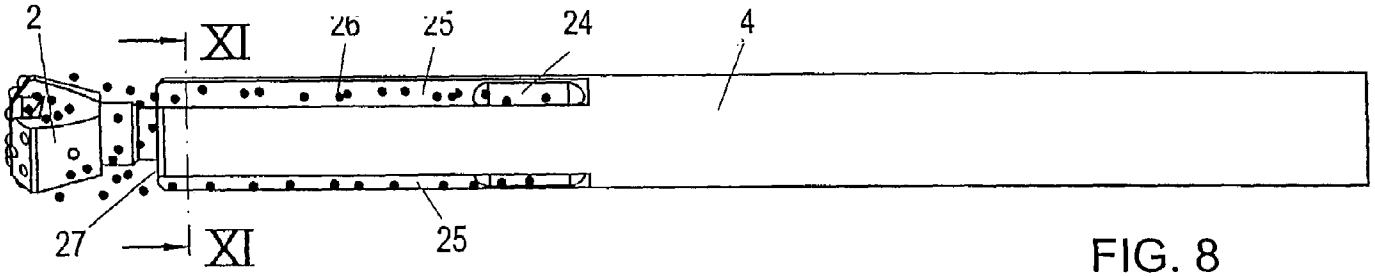
Figure 9:
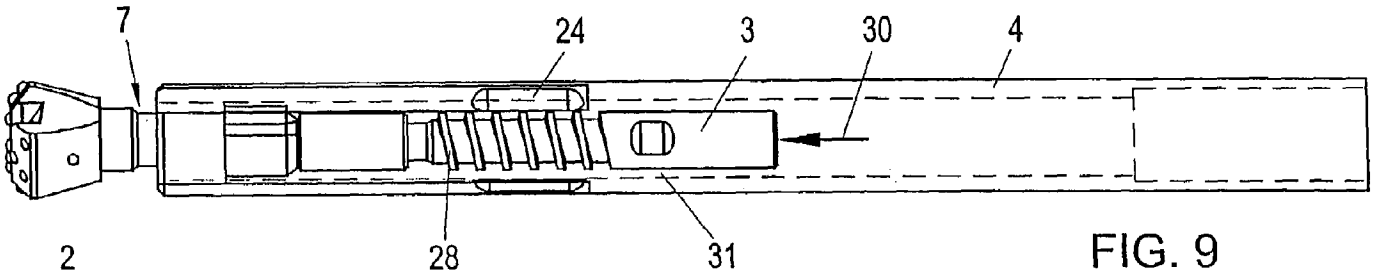
Figure 10:
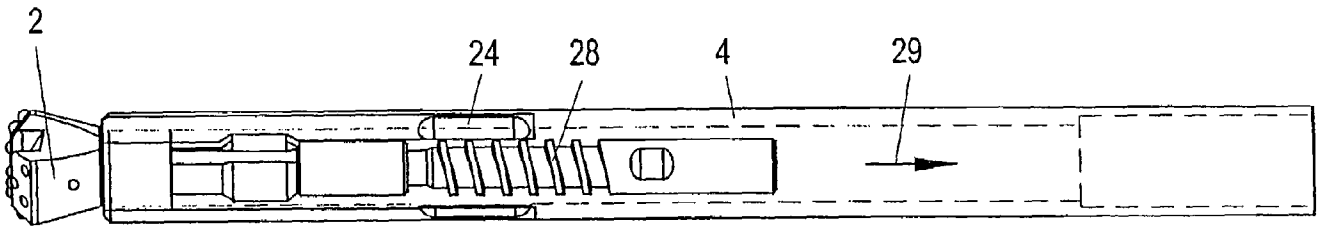
Figure 11:
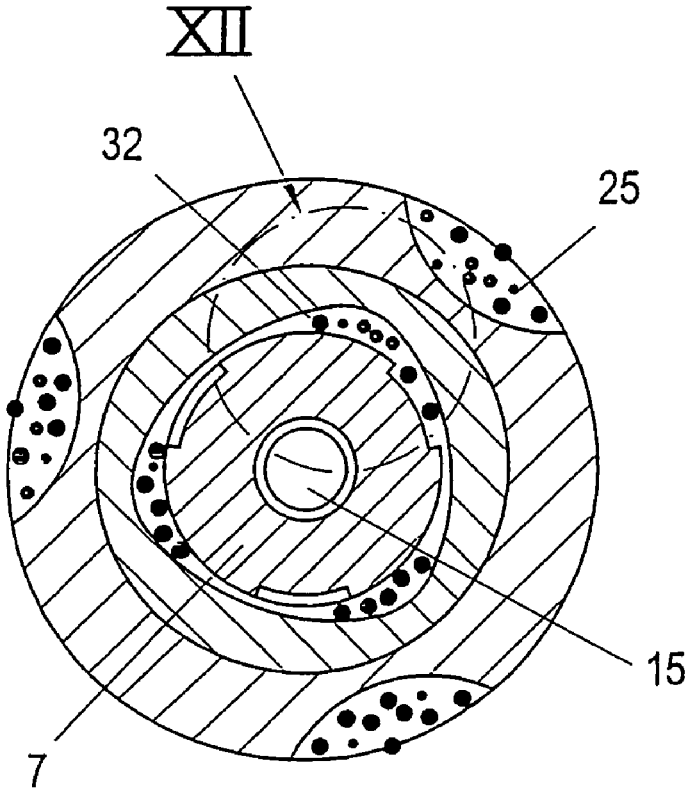
Figure 12:
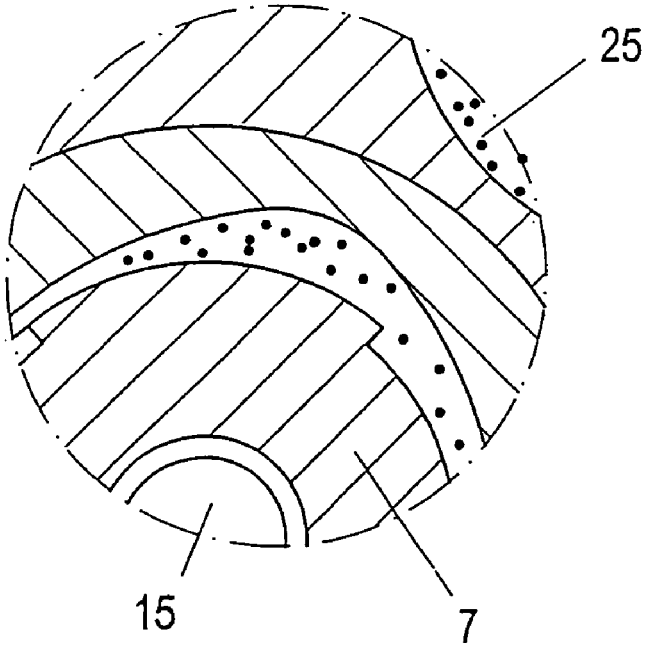

FIG. 8, in an illustration similar to FIG. 2, is a side view of the device according to the invention, merely indicating the region of the envelope tube used for the haulage of excavated material;

FIG. 9 is a partially sectioned illustration of the configuration according to FIG. 8, with the drill bit being arranged at a distance from the envelope tube as in FIG. 8;

FIG. 10, in an illustration similar to FIG. 9, shows the drill bit in a position retracted to abut on the envelope tube;

FIG. 11 illustrates a section along line XI-XI of FIG. 8 in the foremost portion of the envelope tube; and FIG. 12 is a detailed illustration of the region XII of FIG. 11 on an enlarged scale.

DETAILED DESCRIPTION OF THE PREFERRED EMBODIMENTS

Figure 1:
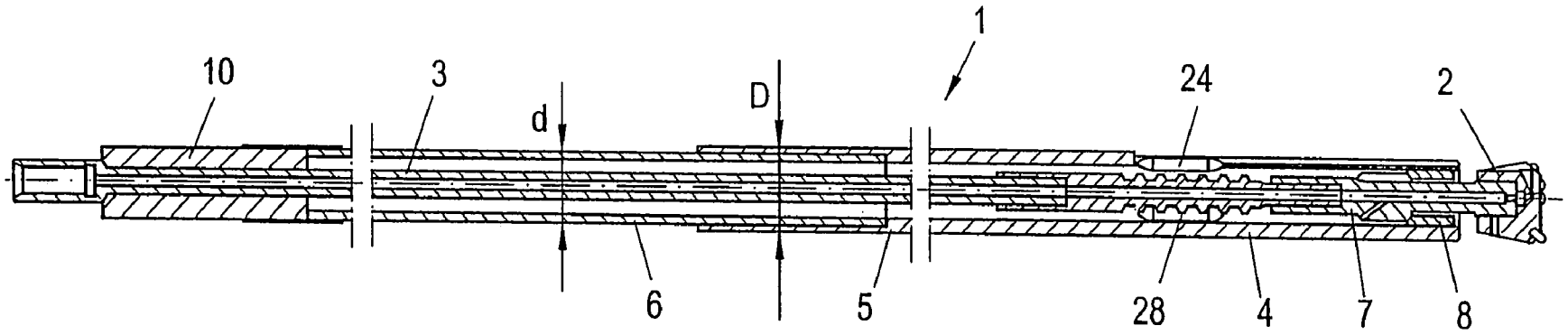
FIG. 1 is a sectional view of a device according to the invention for carrying out the method according to the invention.

From the illustration according to FIGS. 1 and 2, it is apparent that a device for boring, or rotary percussion drilling, which is generally denoted by 1, comprises a drill bit schematically indicated by 2, which is configured for percussion or rotary percussion drilling via a drill rod assembly 3 to excavate material not illustrated in detail in FIGS. 1 and 2.

To the drill bit 2 is connected an envelope tube 4 having a comparably thick cross section and high strength, which envelope tube 4, on its end facing away from the drill bit 2, comprises a socket 5 in which a jacket tube 6 is received, said jacket tube 6 not only having a diameter d that is reduced relative to the diameter D of the envelope tube 4, but also a reduced wall thickness and strength.

Figure 3:
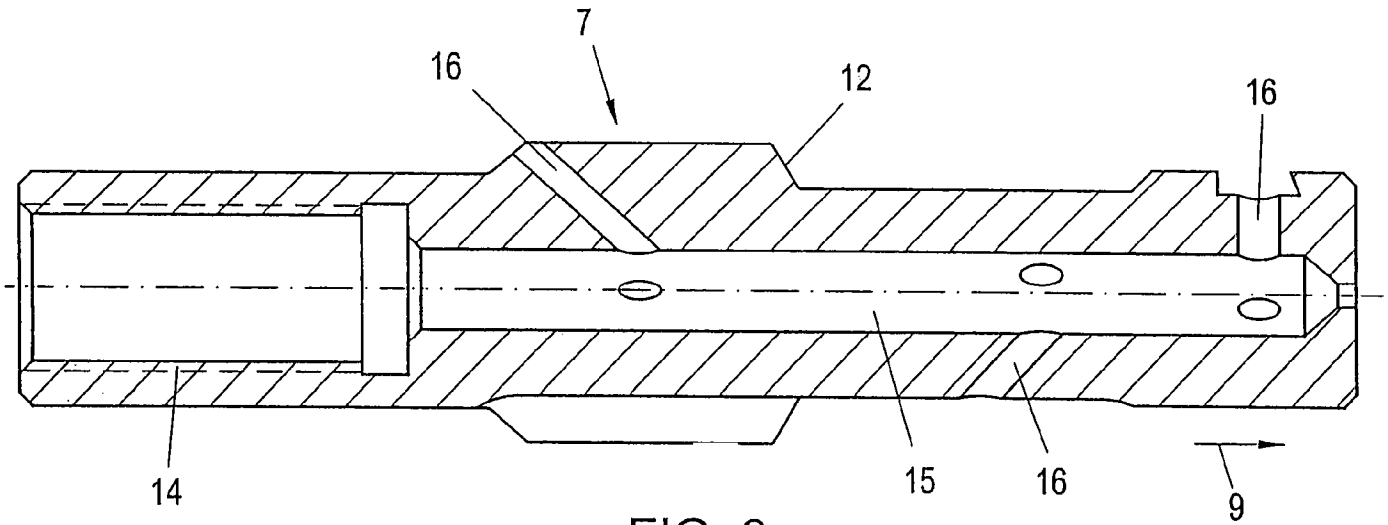
FIG. 3 shows on an enlarged scale an adapter of the device according to the invention for coupling the drill bit with the drill rod assembly and for transmitting a tensile stress onto the envelope tube following upon the drill bit.

The drill bit 2 is directly coupled with the drill rod assembly 3 via an adapter 7 illustrated in detail in FIG. 3, via which adapter 7 also an entrainment and, in particular, tensile stress of the envelope tube 4 via an intermediate element 8 illustrated in detail in FIG. 5*b* is effected.

Considering the fact that the envelope tube 4 has a comparatively large length and, in addition to an appropriate strength, also a diameter D largely corresponding with the dimensions of the borehole formed by the drill bit 2, which is not illustrated in detail, it is ensured by the envelope tube 4 that accurate boring will be feasible.

Figure 4:
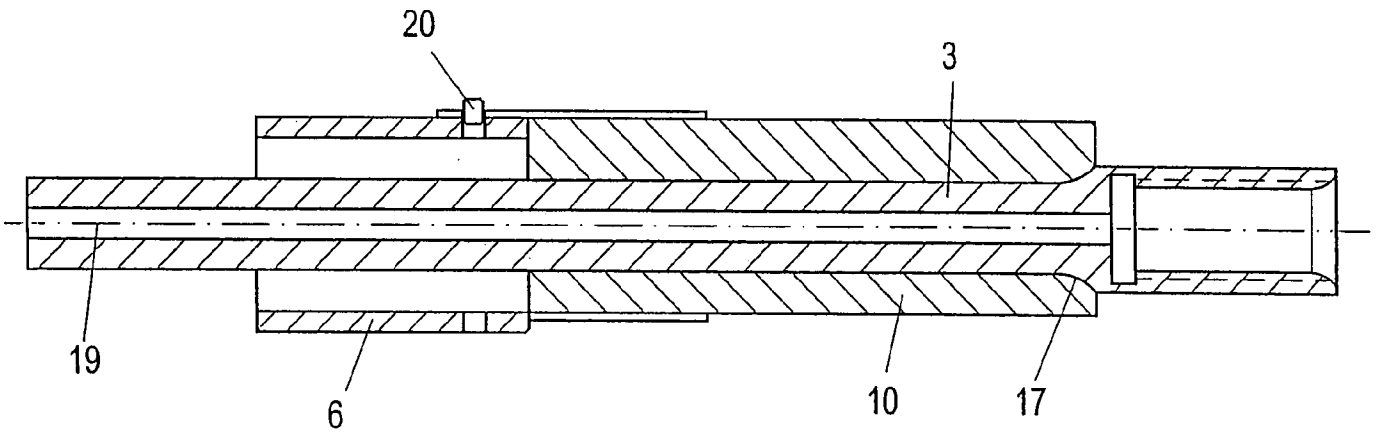
FIG. 4 is a schematic, sectional view of the coupling region between the drill rod assembly and the jacket tube for applying a percussive stress or compressive stress onto the jacket tube of the device according to the invention.

The jacket tube 6, which is received in the socket 5 on the envelope tube end facing away from the drill bit 2 is likewise compressively stressed by the drill rod assembly 3 via a further intermediate element 10 illustrated in more detail in FIGS. 4 and 5*a*, so that the jacket tube 6 is likewise introduced into the borehole in the sense of arrow 11 during the advance working of the drill bit 2.

From the adapter 7 illustrated on an enlarged scale in FIG. 3, it is to be seen that it comprises a stop surface 12 which cooperates with an accordingly complementarily shaped stop surface 13 of the intermediate piece 8 depicted in FIG. 5*b*, so that an entrainment of the envelope tube 4 will be effected in addition to the advance of the drill bit 2 as the adapter 7 is acted upon in the sense of arrow 9 via the drill rod assembly screwed into the screwing 14, which is not illustrated in detail in FIG. 3.

In the illustration according to FIG. 3, passage channels 15 as well as exit openings 16 for flushing the drill 2 and/or entraining excavated material as will be explained in more detail below are additionally indicated within the adapter 7.

The intermediate element 10, which is illustrated in detail in FIGS. 4 and 5*a*, is provided for the percussive or compressive action on the jacket tube 6. The entrainment of the intermediate element 10 and, subsequently, of the jacket tube 6 again is effected via a stop surface 17 in the region of the drill rod assembly 3 projecting from the borehole, the stop surface 17 of the drill rod assembly 3 cooperating with an accordingly complementary stop surface 18.

As is particularly apparent form FIGS. 3 to 5, the stop surfaces of both the adapter 7 and the drill rod assembly 3 as well as the stop surfaces 13 and 18, respectively, of the sleeve-shaped intermediate elements 8 and 10 are each inclined relative to the longitudinal axis of the drill rod assembly, which is indicated by 19 in FIG. 4.

From FIGS. 5*a* and 5*b* it is apparent that the stop surface 18 of the intermediate element 10, which is provided between the drill rod assembly 3 and the jacket tube 6, is smaller than the stop surface 3 of the intermediate element 8 provided between the adapter 7, and hence the drill rod assembly 3, and the envelope tube 4 such that, in the main, a larger force will be transmitted onto the envelope tube 4 than onto the jacket tube 6 at an advance movement of the drill rod assembly 3, thus ensuring that the envelope tube 4 be introduced into the borehole to at least the same extent as the jacket tube 6. Furthermore, it is to be anticipated that, for the introduction of the envelope tube 4 into the borehole, a larger force is required for the proper introduction of the envelope tube 4 on account of the larger diameter and, hence, higher friction resistances formed between the outer diameter of the envelope tube 4 and the wall of the borehole.

In FIG. 4 an additional fixation of the jacket tube 6 by means of a pin or bolt 20 is, moreover, indicated.

Figure 6:
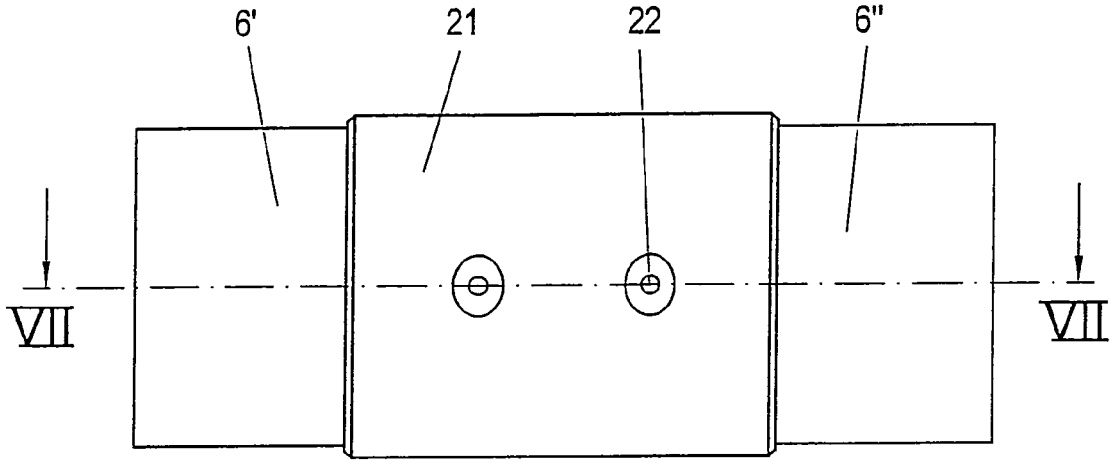
FIG. 6 is an illustration of a connection between two neighboring jacket tube elements on an enlarged scale.
Figure 7:
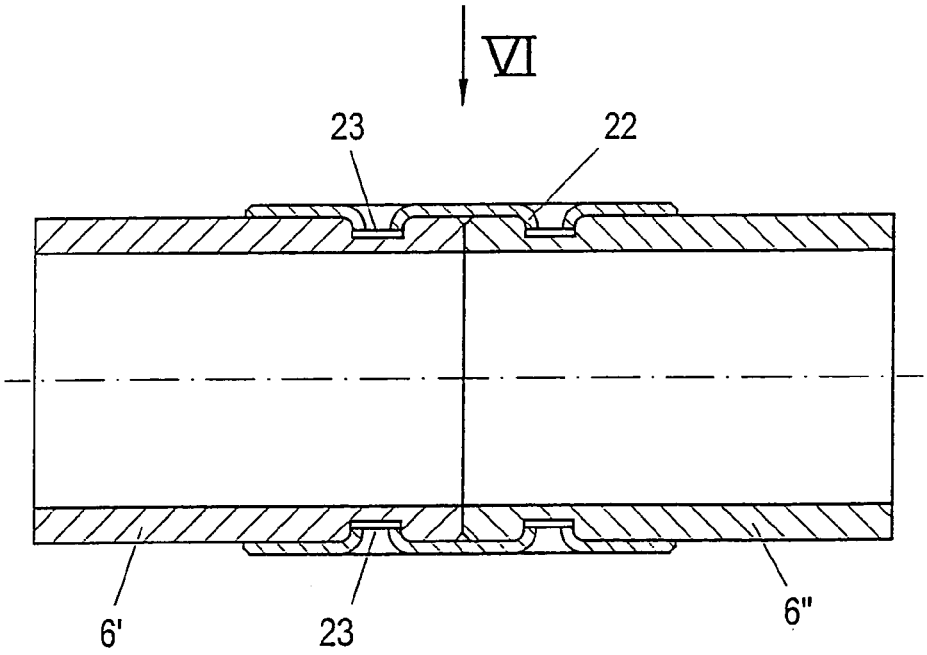
FIG. 7 is a section along line VII of FIG. 6 through the connection of neighboring jacket tube elements, FIG. 6 being a view in the sense of arrow VI of FIG. 7.

For a simple connection between adjacent jacket tube elements 6' and 6", which are indicated in FIGS. 6 and 7, a sleeve-shaped element 21 is each provided, with projections or elevations 22 protruding towards the interior of the jacket tube 6 being indicated, which engage in respective depressions or recesses 23 of the jacket tube to ensure the safe connection of adjacent jacket tube elements 6' and 6". Said projections or elevations 22 may be preformed such that the sleeve element 21 has to exhibit an appropriate elasticity when joining adjacent jacket tube elements 6' and 6", or they may be formed in the region of predetermined breaking points using a simple tool after the arrangement of the sleeve-like element 21 in the region of the jacket tube elements 6' an 6" to be connected.

A plurality of passage openings 24 are indicated in the envelope tube 4 in a spaced-apart relationship relative to the drill bit already in the schematic illustrations of FIGS. 1 and 2, wherein the material haulage from the region of the drill bit 2 is elucidated by way of FIGS. 8 to 12.

In addition to the passage openings 24 provided at a distance from the drill bit 2, wherein accordingly offset or depressed regions 25 extending in the longitudinal direction are provided about the outer circumference of the envelope tube 4 to ensure the conveyance of the excavated material schematically indicated by 26 into the region of the passage openings 24, it is to be anticipated that, on the rear side of the drill bit 2 in the region of the end face 27 of the envelope tube 4, material will enter the region of the front portion of the adapter 7 protruding in the boring position represented in FIGS. 8 and 9.

As is apparent from FIGS. 11 and 12 as well as from the schematic illustration of the sleeve-shaped intermediate element 8 in FIG. 5*b*, the adapter 7 is designed to be polygonal and, in particular, substantially triangular with rounded corners in the connection zone to the drill bit 2 so as to enable material to enter the annular or free space between the drill rod assembly 3, or adapter 7, and the envelope tube 4 in this region too. By the polygonal design 32, 33 of the adapter portion protruding from the envelope tube 4 and the intermediate element 8, it is ensured that excavated material present behind the drill bit 2 is largely disintegrated to enable its safe removal.

For the proper haulage of the material entering the annular space between the envelope tube. 4 and the drill rod assembly 3, in particular, through the passage openings 24, a guide means 28 comprised of a thread-like profile or worm conveyor is additionally provided on the foremost portion of the drill rod assembly 3. The worm conveyor or guide means 28 is, moreover, schematically indicated in FIGS. 1 and 2.

A rotational movement of the drill bit 2 and the drill rod assembly 3 in a counter-clockwise sense ensures the safe haulage of excavated material by the worm conveyor or guide means 28 both through the annular space 31 provided between the envelope tube 4 and the drill rod assembly 3 and through the annular space provided between the drill rod assembly 3 and the jacket tube 6 following upon the envelope tube 4.

In addition to the targeted and accurate boring provided, in particular, by the envelope tube 4 having a relatively high strength and elevated cross section, the selective haulage of excavated material will, thus, render feasible the enhancement of both the boring speed and the directional precision.

For the periodic cleaning of, in particular, the passage openings 24, which may sometimes be obstructed by material to be removed, the drill bit 2 can be retracted in abutment on the envelope tube 4 in the sense of arrow 29, whereby a displacement of the guide means or worm conveyor 28 relative to the passage openings 24 is effected such that a cleaning effect of the passage openings 24 will be obtained by entrainment. In addition, a rotational movement of the drill rod assembly 3 in a sense opposite to the excavation direction proper, i.e., for instance, in a clock-wise direction in the illustration depicted in FIGS. 9 and 10, is able to effect the cleaning of the passage openings 24 by the reversed conveying direction of the worm conveyor 28.

After cleaning, the drill bit 2 is again acted upon in the sense of arrow 30, cf. FIG. 9, to continue the excavation procedure.

By transmitting the forces from the drill rod assembly 3 to the envelope tube 4 and the jacket tube 6 via the interposed sleeve-shaped intermediate elements 8 and 10, respectively, it is, moreover, ensured that the drill bit 2, which is directly coupled with the drill rod assembly 3, is settable both in a rotational and a percussive movement, while both the envelope tube 4 and the jacket tube 6 are introduced into the borehole merely in the axial direction or longitudinal direction of the borehole to be produced, without being rotationally stressed.

The invention claimed is:

1. A method for boring or drilling, including percussion drilling or rotary percussion drilling, holes in soil or rock, comprising the steps of: forming a borehole by a percussive and/or rotary movement carried out by a drill bit mounted on a drill rod assembly; and introducing a jacket tube coupled with the drill bit into the borehole; wherein the jacket tube is received in a socket provided on the end facing away from the drill bit working surface, of an envelope tube coupled with the drill bit, and that the jacket tube is subjected to a percussive and/or compressive stress on its end facing away from the drill bit; wherein, for the coupling of the envelope tube with the drill bit, a sleeve-like intermediate element is provided for the transmission of a tensile stress exerted by the drill rod assembly on the envelope tube; and wherein a stop surface of the sleeve-shaped intermediate elements provided between the drill rod assembly and the envelope tube as well as between the drill rod assembly and the jacket tube end facing away from the drill bit is each comprised of a stop surface enclosing an acute angle with the longitudinal axis of the drill rod assembly and the envelope tube and the jacket tube, which stop surfaces cooperate with respective complementary stop surfaces of the drill rod assembly or an adapter coupled therewith.

2. The method according to claim 1, wherein the compressive stress acting on the jacket tube on its end facing away from the drill bit is chosen to be smaller than the tensile stress exerted by the drill bit on the envelope tube.

3. The method according to claim 1, wherein the drill bit is rotationally mounted relative to the envelope tube and/or jacket tube.

4. The method according to claim 1, wherein excavated material, via at least one opening provided in the region of the connection site between the drill bit and the envelope tube and/or a passage opening provided at a distance from the connection site between the drill bit and the envelope tube, is introduced into the annular space defined between the outer periphery of the drill rod assembly and the inner peripheries of the envelope tube and the adjoining jacket tube, and carried off the borehole.

5. A device for boring or drilling, including percussion drilling or rotary percussion drilling, holes in soil or rock, wherein a borehole is formed by a percussive and/or rotary movement carried out by a drill bit mounted on a drill rod assembly and a jacket tube coupled with the drill bit is capable of being introduced into the borehole, wherein the jacket tube is received in a socket provided on the end facing away from the drill bit working surface, of an envelope tube coupled with the drill bit, and that a percussive and/or compressive stress is exerted on the end of the jacket tube facing away from the drill bit; wherein, for the coupling of the envelope tube with the drill bit, a sleeve-like intermediate element is provided for the transmission of a tensile stress exerted by the drill rod assembly on the envelope tube; and wherein a stop surface of the sleeve-shaped intermediate elements provided between the drill rod assembly and the envelope tube as well as between the drill rod assembly and the jacket tube end facing away from the drill bit is each comprised of a stop surface enclosing an acute angle with the longitudinal axis of the drill rod assembly and the envelope tube and the jacket tube, which stop surfaces cooperate with respective complementary stop surfaces of the drill rod assembly or an adapter coupled therewith.

6. The device according to claim 5, wherein a sleeve-like intermediate element is provided for the transmission of a compressive strength exerted by the drill rod assembly on the jacket tube.

7. The device according to claim 5, wherein the stop surface of the intermediate element provided between the drill rod assembly and the envelope tube is larger than the stop surface of the intermediate element provided between the drill rod assembly and the jacket tube end facing away from the drill bit.

8. The device according to claim 5, wherein the drill bit is rotationally mounted relative to the envelope tube and/or jacket tube.

9. The device according to claim 5, wherein the outer diameter of the envelope tube exceeds the outer diameter of the jacket tube.

10. The device according to claim 5, wherein the envelope tube has an elevated cross section and/or elevated strength relative to the jacket tube.

11. A device for boring or drilling, including percussion drilling or rotary percussion drilling, holes in soil or rock, wherein a borehole is formed by a percussive and/or rotary movement carried out by a drill bit mounted on a drill rod assembly and a jacket tube coupled with the drill bit is capable of being introduced into the borehole, wherein the jacket tube is received in a socket provided on the end facing away from the drill bit working surface, of an envelope tube coupled with the drill bit, and that a percussive and/or compressive stress is exerted on the end of the jacket tube facing away from the drill bit; and wherein, for the connection of adjoining jacket tube elements, sleeve-like elements are provided, each overlapping adjoining end regions of the jacket tube elements and formed, or capable of being formed, with projections or elevations engaging in complementary depressions or recesses provided about the peripheries of the jacket tube elements.

12. The device according to claim 11, wherein the sleeve-like elements are designed to have reduced material cross sections in the region of the projections or elevations, and that the projections or elevations are capable of being formed to correspond with the depressions of the jacket tube elements after the arrangement of the sleeve-like elements on the outer peripheries of the jacket tube elements to be connected.

13. The device according to claim 11, wherein additional securing elements are provided for the positioning and/or fixing of the sleeve-like elements.

14. A device for boring or drilling, including percussion drilling or rotary percussion drilling, holes in soil or rock, wherein a borehole is formed by a percussive and/or rotary movement carried out by a drill bit mounted on a drill rod assembly and a jacket tube coupled with the drill bit is capable of being introduced into the borehole, wherein the jacket tube is received in a socket provided on the end facing away from the drill bit working surface, of an envelope tube coupled with the drill bit, and that a percussive and/or compressive stress is exerted on the end of the jacket tube facing away from the drill bit; and wherein, in the region of fixation of the envelope tube to the drill bit and/or an impact shoe or adapter connected therewith, at least one passage opening for the introduction of excavated material into the annular space formed between the outer periphery of the drill rod assembly and the inner peripheries of the envelope tube and the adjoining jacket tube is provided.

15. The device according to claim 14, wherein the drill bit, or an adapter connected therewith, on its rear side facing away from the working surface, is provided with a polygonal profile which, at a retraction relative to the envelope tube, enters a complementary polygonal reception opening of the adapter or intermediate element for coupling with the envelope tube.

16. The device according to claim 14, wherein at least one passage opening is provided on the periphery of the envelope tube at a distance from the connection site between the drill bit and/or adapter and the envelope tube, which passage opening opens into the interior of the annular space defined between the outer periphery of the drill rod assembly and the inner periphery of the envelope tube.

* * * * *